United States Patent [19]

Dussourd et al.

[11] Patent Number: 4,718,455

[45] Date of Patent: Jan. 12, 1988

[54] PLATE-TYPE FLUID CONTROL VALVE

[75] Inventors: Jules L. Dussourd, Princeton, N.J.; Robert E. Drews, Elmira, N.Y.

[73] Assignee: Ingersoll-Rand Company, Woodcliff Lake, N.J.

[21] Appl. No.: 927,134

[22] Filed: Nov. 5, 1986

[51] Int. Cl.[4] ..... F16K 7/12

[52] U.S. Cl. ..... 137/625.3; 137/625.33; 251/206

[58] Field of Search ..... 137/625.28, 625.3, 625.33; 251/206

[56] References Cited

U.S. PATENT DOCUMENTS

| | | | |
|---|---|---|---|
| 4,050,479 | 9/1977 | Baumann | 137/625.3 |
| 4,538,642 | 9/1985 | Schutten et al. | 137/625.28 |
| 4,559,275 | 12/1985 | Matt et al. | 137/625.28 |

FOREIGN PATENT DOCUMENTS

| | | | |
|---|---|---|---|
| 1052195 | 3/1959 | Fed. Rep. of Germany | 251/206 |
| 1221867 | 7/1966 | Fed. Rep. of Germany | . |

*Primary Examiner*—A. Michael Chambers

*Attorney, Agent, or Firm*—B. J. Murphy

[57] ABSTRACT

The valve has a ported valving element which removes from, and seats upon, a ported valve seat, to open and close the valve to fluid flow through a ported stop plate, and the valving element, in relation to ports in the stop plate, has relieved steps formed therein to create rolling vortices in the through-flowing fluid. Additionally, the valve, in a first embodiment thereof, has two ported buffer plates, however, the latter, vis-a-vis the stop plate ports, have no steps; rather the ports therein are of the same dimension as the ports in the stop plate with which they align or register.

11 Claims, 3 Drawing Figures

PLATE-TYPE FLUID CONTROL VALVE

Figure 1:
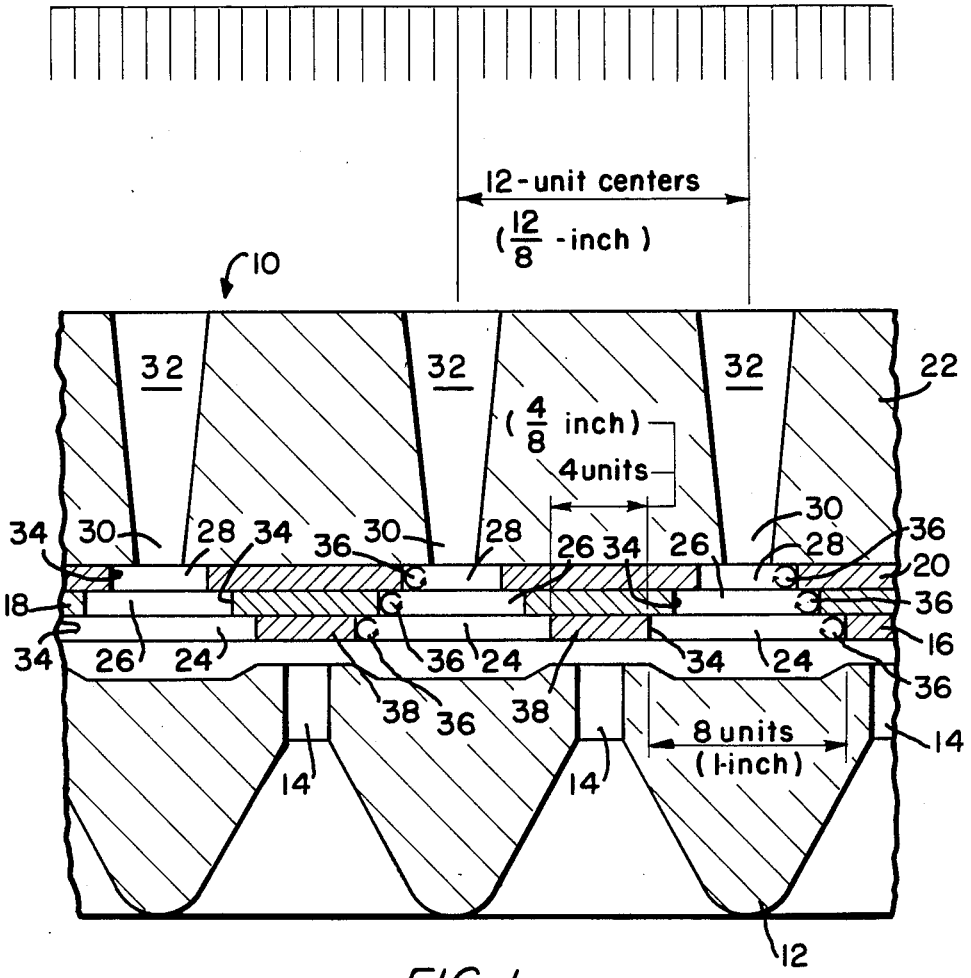
FIG. 1 PRIOR ART

This invention pertains to plate-type, fluid control valves, and in particular to such valves of the aforesaid type, which are used in gas compressors, especially, modified to yield a more efficient fluid flow therethrough.

In the prior art there is German patent publication No. 1,221,867, filed May 26, 1961 and published Jul. 28, 1966, for a "Plate Valve" invented by Robert Kohler, and assigned to Hoerbiger Ventilwerke, Aktiengesellschaft, Vienna, Austria.

In the aforesaid German publication, the invention teaches the concept of forming steps (a) in the ported valving element, relative to the stop plate ports, and (b) in associated, ported, damper or buffer plates, or forming such steps in the damper or buffer plates—in lieu of providing them in the valving element, evidently.

The inventor, Kohler, explained that tests have shown that the steps provided at suitable points of the flow path lead to the formation of rolling vortices, as the fluid medium flows through the valve. The latter assume the task of port periphery radii. These rolling vortices completely replace the radii, which are difficult to manufacutre, and enable a nearly frictionless passage of the fluid medium sliding, as on roller bearings, thereby keeping the flow losses of the valves extremely low.

As noted, the German publication teaches the provisioning of steps in the valving element and the buffer plates, or just in the buffer plates. Now, notwithstanding the commendable merits of the inventor's teaching, we have determined that practicing just the contrary of his proposition will, unexpectably, provide an improved valve.

It is an object of our invention to disclose how, by building on Kohler's concept, to define an improved plate-type, fluid control valve in which (a) damper plates and/or buffer plates, if employed, are not stepped, and (b) with or without damper and/or buffer plates, only the valving element is stepped.

Particularly, it is an object of this invention to set forth a plate-type, fluid control valve, comprising a ported valve seat; a ported stop plate; a ported valving element movably disposed between said seat and plate, and having each port therein directly aligned with a corresponding port in said stop plate; and at least one, ported, buffer plate movably disposed between said valve seat and said stop plate; wherein each port in said valving element is wider than such corresponding port in said stop plate with which it is directly aligned.

It is another object of this invention to set forth a plate type, fluid control valve, comprising a ported valve seat, a ported stop plate, and only a single plate-type element movably disposed between said seat and plate, wherein said element comprises a ported valving plate having each port therein directly aligned with a corresponding port in said stop plate, and each said port in said valving plate is wider than such corresponding port in said stop plate with which it is directly aligned.

Figure 2:
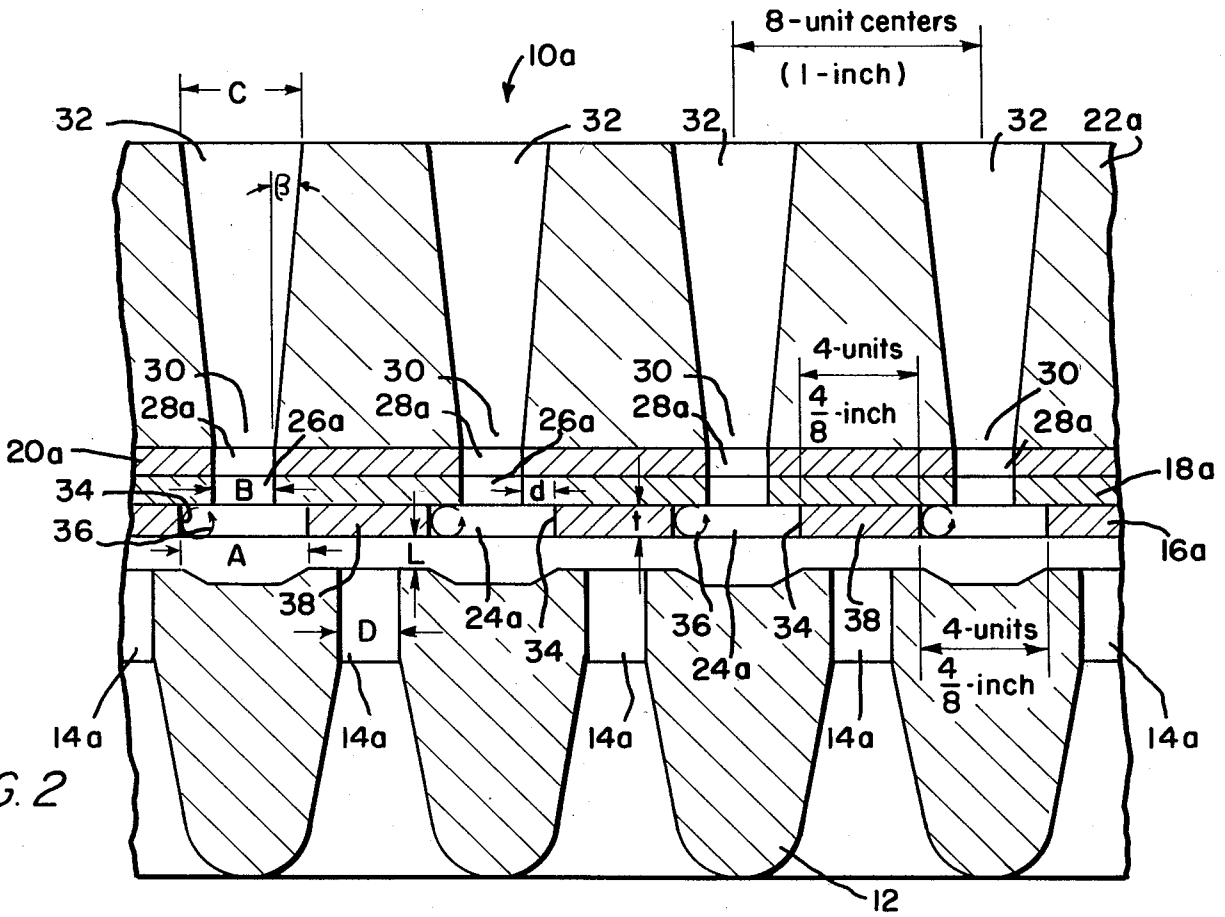
Figure 3:
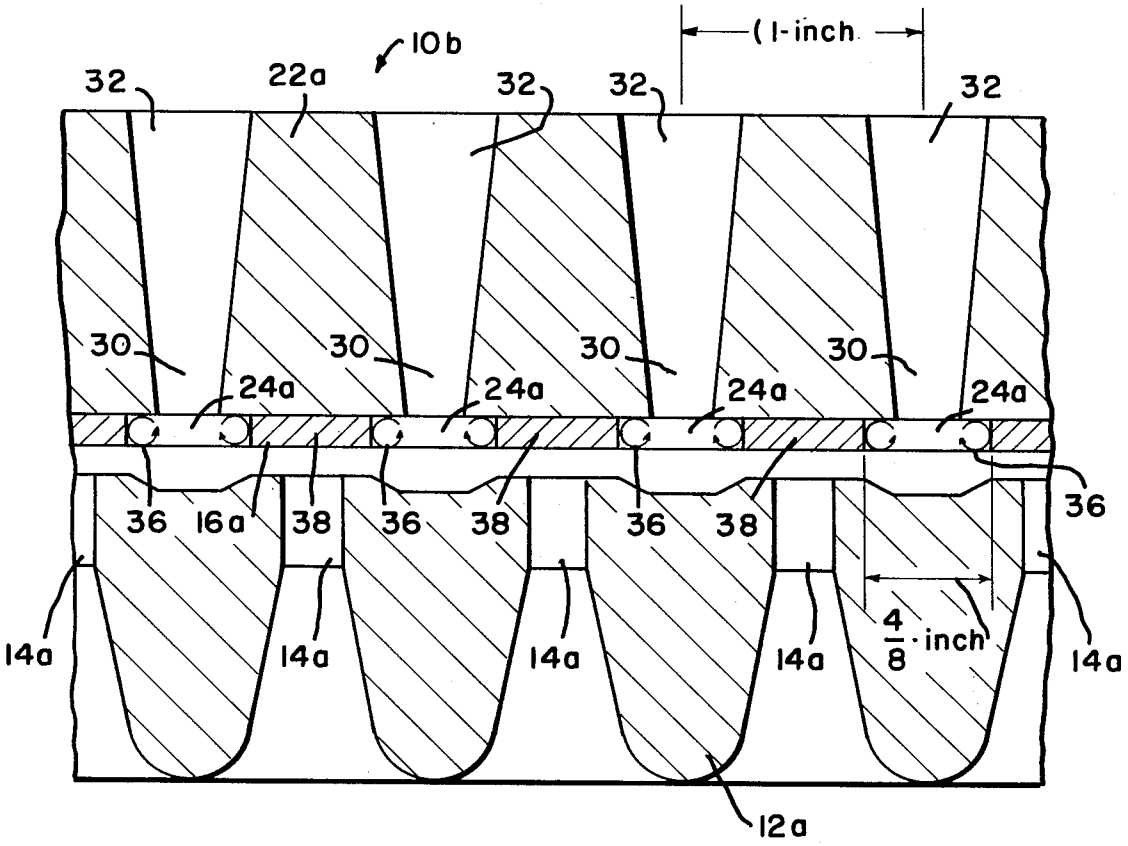

Further objects of this invention, as well as the novel features thereof, will become more apparent by reference to the following description, taken in conjunction with the accompanying figures, in which:

FIG. 1 is a cross-sectional view taken through a prior art type of plate-type, fluid control valve which exemplifies the teachings of the aforecited German patent publication; and FIG. 2 is a view like that of FIG. 1, on an enlarged scale, however, of a plate-type, fluid control valve, according to a first embodiment of our invention; and FIG. 3 is a view, like that of FIG. 2, of an alternative embodiment of our invention.

As shown in FIG. 1, a plate-type, fluid control valve 10 comprises a seat plate 12 having a plurality of ports 14 formed therein. Shown in elevation (i.e., depicting and "open" valve) above the seat plate 12 are a valving element 16, a first buffer plate 18, and a second buffer plate 20. Finally, there is provided a ported stop plate 22.

Valving element 16 has a plurality of ports 24 formed therein. So too, plates 18, 20 and 22 have corresponding ports 26, 28 and 30, respectively, formed therein. Ports 30 define terminations of diverging channels 32 formed through the stop plate 22.

According to the teaching in the aforecited German patent publication, valving element 16, and plates 18 and 20 have steps 34 formed therein. Consequently, at each of the steps are created the rolling vortices 36. Now, notwithstanding the so-called "nearly frictionless passage . . . 38 of the fluid through the valve 10, the valve 10 is of structurally poor and inefficient design.

The aspect ratio of each step 34, i.e., the width to depth ratio, is in the order of one. Thus are the beneficial rolling vortices 36 created. However, the steps 34 are cumulative. Assuming that the channels are on centers of twelve dimensional "units"—whatever the dimensional units may be—then, to accommodate all the steps 34, ports 24 have to be eight units wide. Arbitrarily, for illustrative purposes, the "units" may be considered to be eighths of an inch. Now, to keep the flow-through paths as close together as possible, only the minimum widths of ligaments 38 are provided between adjacent ports 24.

The ligaments 38 are only four units (i.e., four-eighths or one-half inch) in width. This circumstance, coupled with the greater width—eight units (i.e., one inch)—of the ports 24 define a structurally very weak valving element 16, one subject to fracture for having too little structural integrity for the cumulative area of voids therein.

Our improved valve **10*a* is shown in FIG. 2; in FIG. 2, same or similar index numbers, as compared to those in FIG. 1**, denote same or similar structures, components or elements.

In our novelly designed valve **10*a* the channels 32 are on eight unit centers (i.e., one-inch centers), the ports 24*a* in the valving element 16*a* are only of four units' i.e., four-eighths, or half-inch, width, and the ligaments 38 are of the same four units' width. The element 16*a*, then, is of durable structure. Even so, it has the steps 34 formed therein which provide the rolling vortices 36. The buffer plates 18*a* and 20*a* have ports 26*a* and 28*a* formed therein which are of the same dimensions (allowing for manufacturing tolerances) as ports 30 in the stop plate 22*a***.

The flow-through paths provided in our valve **10*a* are efficiently close and, as can be seen, for any given area of whatever units (millimeters, or fractions/portions of an inch) are used, are greater in number than in the prior art valve 10**. They are close-packed.

Tests show that valving elements, such as element **16*a*, which have wide ligaments between the ports therein are stronger than valving elements with narrow ligaments. Accordingly, if our valve 10a had the spacing of ports 14 and 30 as in the prior art valve 10 (FIG. 1), and only stepped the valve ports—according to our teaching—the ligaments 38 of our valving element 16a would be quite wide (i.e., eight units, or one-inch), with the same four units' (or one-half inch) wide ports 24a**.

The prior art valve 10, of FIG. 1, has the valving element 16 with ligaments 38, between the ports 24, of four units' width. The same is true of the ligaments 38 in our valving element 16a. However, by dispensing with the steps in the buffer plates (as taught by the aforesaid inventor Kohler), our ports 14a and 30 are on only eight unit centers. Accordingly, with the same ligament width as in the prior art valve 10, our valve 10a presents a thirty-three percent increase in flow area. Essentially, it is our teaching, then, to step only the valving element 16a, and keep the ports 30, 28a, and 26a of one, common dimension (within manufacturing tolerances).

In our experimentations with our valve design, in which only the valving element 16a has the steps 34, we arrived at an optimum configuration range. With reference to FIG. 2, we determined that the following relationships defined a superior valve:

a. $(A-B)/2t$=not less than 0.7 nor more than 1.2
b. $B/L$=not less than 1.3 nor more than 1.9
c. $D/L$=not less than 1.7
d. $\beta$=approximately 5°
e. $C/B$=approximately 2.0
f. $A-B/2t=d/t$ While we have described our invention in connection with a specific embodiment thereof, it is to be clearly understood that this is done only by way of example and not as a limitation to the scope of our invention as set forth in the objects thereof and in the appended claims.

For instance, the invention lends itself to practice in a valve in which there are no buffer plates, and a valving plate is the only element interposed between the stop plate and the seat. Such a valve is shown in FIG. 3.

FIG. 3 depicts a valve 10b in which same or similar index numbers denote same or similar structures, components or elements as in FIG. 1 and/or 2. Valve 10b has a same stop plate 22a and valve seat 12 as is in valve 10a (FIG. 2). Too, a same valving element 16a is employed. Here, however, element 16a is the only component interposed between the plate 22a and the seat 12a. According to our teaching, however, valve 10b has the rolling vortexes 36, due to the ports 24a being wider than the ports 30, and defining the steps 34.

We claim:

1. A plate-type, fluid control valve, comprising:
a ported valve seat;
a ported stop plate;
a ported valving element movably disposed between said seat and plate, and having each port therein directly aligned with a corresponding port in said stop plate; and
at least one, ported, buffer plate movably disposed between said valve seat and said stop plate; wherein
each said port in said valving element is wider than such corresponding port in said stop plate with which it is directly aligned;
said ports in said valving element are separated therebetween by ligaments; and
each of said ligaments has a width which is not less than the width of a valving element port immediately adjacent thereto.

2. A plate-type, fluid control valve, according to claim 1, wherein:
said ports in said valving element and in said buffer plate are in common alignment, and define a step therebetween; and
said step has a width and depth of one, common dimension.

3. A plate-type, fluid control valve, according to claim 1, further including:
a second, ported buffer plate movably disposed between said one buffer plate and said stop plate; and wherein
ports in both of said buffer plates are all of one, given width.

4. A plate-type, fluid control valve, according to claim 1, wherein:
each port in said valving element is of a given width dimension; and
ports in said stop plate are on centers which are spaced apart by a dimension which is not more than twice said given width dimension.

5. A plate-type, fluid control valve, comprising:
a ported valve seat;
a ported stop plate;
a ported valving element movably disposed between said seat and plate, and having each port therein directly aligned with a corresponding port in said stop plate; and
at least one, ported, buffer plate movably disposed between said valve seat and said stop plate; wherein
each said port in said valving element is wider than such corresponding port in said stop plate with which it is directly aligned;
said ports in said valving element are separated therebetween by ligaments; and
each of said ligaments has a width which is equal to the width of a valving element port immediately adjacent thereto.

6. A plate-type, fluid control valve, comprising:
a ported valve seat;
a ported stop plate;
a ported valving element movably disposed between said seat and plate, and having each port therein directly aligned with a corresponding port in said stop plate; and
at least one, ported, buffer plate movably disposed between said valve seat and said stop plate; wherein
each said port in said valving element is wider than such corresponding port in said stop plate with which it is directly aligned;
ports in said stop plate are on centers which are spaced apart by a given dimension; and
said ports in said valving element have widths of only half said given dimension.

7. A plate-type, fluid control valve, comprising:
a ported valve seat;
a ported stop plate; and
only a single plate-type element movably disposed between said seat and plate; wherein
said element comprises a ported valving plate having each port therein directly aligned with a corresponding port in said stop plate; and
each said port in said valving plate is wider than such corresponding port in said stop plate with which it is directly aligned.

8. A plate-type, fluid control valve, according to claim 7, wherein:

said ports in said stop plate and in said valving element, as a consequence of said valving plate ports being wider, define a step therebetween; and said step has a width and depth of one, common dimension.

9. A plate-type, fluid control valve, according to claim 7, wherein:

said ports in said valving plate are separated therebetween by ligaments; and each of said ligaments has a width which is not less than the width of a valving plate port immediately adjacent thereto.

10. A plate-type, fluid control valve, according to claim 7, wherein:

said ports in said valving plate are separated therebetween by ligaments; and each of said ligaments has a width which is equal to the width of a valving element port immediately adjacent thereto.

11. A plate-type, fluid control valve, according to claim 7, wherein:

each port in said valving plate is of a given width dimension; and ports in said stop plate are on centers which are spaced apart by a dimension which is not more than twice said given width dimension.

* * * * *